US011136839B2

(12) United States Patent
St. Pierre et al.

(10) Patent No.: US 11,136,839 B2
(45) Date of Patent: Oct. 5, 2021

(54) BIT BREAKER BOX

(71) Applicant: Ulterra Drilling Technologies, L.P., Fort Worth, TX (US)

(72) Inventors: Beau St. Pierre, Hudson Oaks, TX (US); Dennis Dison, Enid, OK (US)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 444 days.

(21) Appl. No.: 16/242,522

(22) Filed: Jan. 8, 2019

(65) Prior Publication Data

US 2020/0217152 A1 Jul. 9, 2020

(51) Int. Cl.
*E21B 19/18* (2006.01)

(52) U.S. Cl.
CPC ..... *E21B 19/18* (2013.01)

(58) Field of Classification Search
CPC ..... E21B 19/18; E21B 19/16; E21B 19/167; B25B 7/04; B25B 7/02
See application file for complete search history.

(56) References Cited

U.S. PATENT DOCUMENTS 1,498,026 A * 6/1924 Fuller ..... E21B 19/10 188/67
1,600,864 A * 9/1926 Baker ..... E21B 19/10 175/423
1,952,595 A * 3/1934 Johnson ..... E21B 19/10 175/423
1,999,519 A * 4/1935 Standlee ..... E21B 19/10 188/67
2,063,361 A * 12/1936 Baash ..... E21B 19/10 175/423
2,223,600 A * 12/1940 Carleton ..... E21B 19/18 81/119
3,554,298 A * 1/1971 Klein ..... E21B 19/167 173/164
4,495,840 A * 1/1985 Freitag ..... E21B 19/18 175/315
6,311,789 B1 * 11/2001 Saxman ..... E21B 19/18 175/57
10,428,604 B2 * 10/2019 Odegard ..... E21B 19/18
2017/0314344 A1 * 11/2017 Tavakoli ..... E21B 17/042

* cited by examiner

*Primary Examiner* — Kipp C Wallace
(74) *Attorney, Agent, or Firm* — Kilpatrick Townsend & Stockton LLP

(57) ABSTRACT

A bit breaker for coupling a drill bit to a drilling string includes a base defining a central opening and a wrench portion extending upward from the base. The wrench portion has two opposing lateral sides and an end wall that define an open interior that receives a shank of a drill bit. The open interior and the central opening are in alignment. A handle is coupled with the base and is movable between a storage position in which a top of the handle is positioned below a top surface of the wrench portion and a toting position in which the handle extends upward with the top of the handle positioned above the top surface. A gate is movably positioned between a retaining position in which the gate encloses the open interior of the wrench portion and an access position that provides lateral access to the open interior.

20 Claims, 3 Drawing Sheets

BIT BREAKER BOX

BACKGROUND OF THE INVENTION

In the oil and gas industry, drill bits are connected to a downhole end of a string of tubulars for drilling a wellbore using a bit breakers. However, the design of conventional bit breakers leads to several problems related to visibility and tooling access. For example, in conventional bit breakers, the handles get in the way of the tongs used to make and break the connection between the drill string and the drill bit. These handles are often removed to increase the amount of access personnel have to the drill bit. However, removing the handles may create safety issues as well as make the bit breaker difficult to move and/or otherwise manipulate.

BRIEF SUMMARY OF THE INVENTION

Embodiments of the present invention provide bit breaker boxes that provide greater tooling access by raising the height of a wrench portion of the bit breaker box relative to the base and/or other features, such as handles and/or gate. By increasing the height of the wrench, the shank of the drill bit may be secured at a higher position relative to the rig master bushing, which increases the amount of shank that is accessible to drilling personnel to view, connect, adjust, and/or otherwise interact with the bit and the drill string.

In one embodiment, a bit breaker for coupling a drill bit to a drilling string is provided. The bit breaker may include a generally rectangular base having a first side structure and a second side structure. The generally rectangular base may define a central opening extending from a center of the generally rectangular base through first end of the generally rectangular base. The bit breaker may also include a wrench portion extending upward from the base, the wrench portion having two opposing lateral sides and an end wall that define an open interior that is configured to receive a shank of a drill bit. The open interior and the central opening may be in alignment with one another. The bit breaker may further include a first handle having a first slidable portion that extends through at least a portion of the first side structure and a stiffening retaining member coupled with a bottom portion of the first handle. The bit breaker may include a second handle having a second slidable portion that extends through at least a portion of the second side structure and a stiffening retaining member coupled with a bottom portion of the second handle. Each of the first handle and the second handle may be movable between a storage position in which a top of the respective handle is positioned below a top surface of the wrench portion and a toting position in which the respective handle extends upward with the top of the respective handle being positioned above the top surface of the wrench portion. The bit breaker may also include a gate that is movable between a retaining position in which the gate encloses the open interior of the wrench portion and an access position that provides lateral access to the open interior.

In some embodiments, the gate may be pivotally coupled with the base. The gate may optionally include a locking mechanism that maintains the gate in the retaining position when engaged. The locking mechanism may include a pin that is insertable through a first opening defined by a body of the gate and a second opening defined by the base. In some embodiments, a top surface of the gate is at a height that is lower than the top surface of the wrench portion. In some embodiments, an interior surface of each of the two opposing lateral sides is generally flat and an interior surface of the end wall is generally concave to define an elongate slot with a curved end that forms the open interior of the wrench portion. In some embodiments, the base may further include a corner reinforcement member extending downward from each corner of the generally rectangular plate. In some embodiments, the first handle may be positioned outside of a first of the two opposing lateral sides and the second handle may be positioned outside of a second of the two opposing lateral sides. Each of the first handle and the second handle may form a closed loop structure that is slidable relative to the base. Each stiffening retention member may be configured to contact an underside of the respective side structure to limit a distance the respective handle extends upward from the base. In some embodiments, the wrench portion is formed from a stronger material than the base.

In another embodiment, a bit breaker for coupling a drill bit to a drilling string includes a base defining a central opening and a wrench portion extending upward from the base. The wrench portion may have two opposing lateral sides and an end wall that define an open interior that is configured to receive a shank of a drill bit. The open interior and the central opening may be in alignment with one another. The bit breaker may also include at least one handle coupled with the base. The at least one handle may be movable between a storage position in which a top of the at least one handle is positioned below a top surface of the wrench portion and a toting position in which the at least one handle extends upward with the top of the at least one handle is positioned above the top surface of the wrench portion. The bit breaker may further include a gate that is movable between a retaining position in which the gate encloses the open interior of the wrench portion and an access position that provides lateral access to the open interior.

In some embodiments, the handle includes a handle portion, two slidable portions that extend through at least a portion of the base and are coupled with the handle, and a stiffening retention member coupled with the two slidable portions at a position below the at least the portion of the base. In some embodiments, the stiffening retention member may be configured to contact an underside of the at least a portion of the base to limit a distance the at least one handle extends upward from the base. The at least one handle may optionally be slidable from the storage position and the toting position by applying upward force to the at least one handle and may be configured to return from the toting position to the storage position when no upward force is applied to the at least one handle.

In some embodiments, the gate may be pivotally coupled with the base. The gate may include a locking mechanism that maintains the gate in the retaining position when engaged. The locking mechanism may include a pin that is insertable through a first opening defined by a body of the gate and a second opening defined by the base. A top surface of the gate may be at a height that is lower than the top surface of the wrench portion. In some embodiments, an interior surface of each of the two opposing lateral sides may be generally flat and an interior surface of the end wall may be generally concave to define an elongate slot with a curved end that forms the open interior of the wrench portion. In some embodiments, the base may have a generally rectangular plate from which the wrench potion extends. The generally rectangular plate may define a slot extending from a first side to a center of the generally rectangular plate. The base may further include a corner reinforcement member extending downward from each corner of the generally rectangular plate.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to bit breakers that are used to thread drill bits onto drill strings in oil drilling operations. The bit breakers described herein provide greater access to the drill bit shank, as well as increase the visibility of the shank when being threaded onto a drill string. This increased access and visibility not only makes it easier for drilling personnel to manipulate tooling around the drill bit, but also helps increase safety. While discussed primarily in relation to oil drilling operations, it will be appreciated that the bit breakers may be utilized in any other large scale drilling operations.

Figure 1:
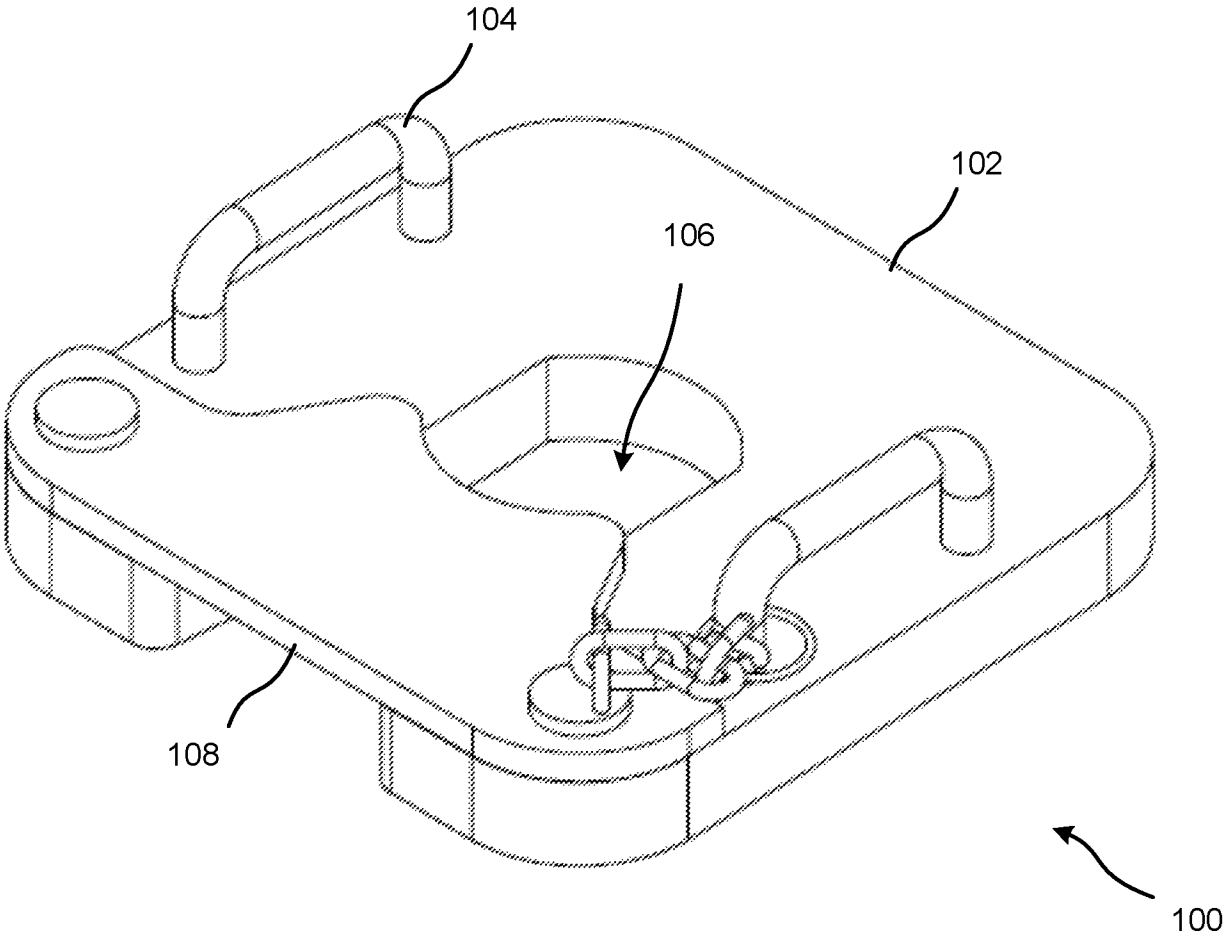
FIG. 1 Prior Art
FIG. 1 depicts a prior art bit breaker.

Turning to FIG. 1, a prior art bit breaker 100 is illustrated. Here, bit breaker 100 includes a generally u-shaped wrench portion 102 that is configured to be placed around a shank of a drill bit, with the interior of the u-shape being in the form of a slot 106 that is configured to engage the flats of a shank of a drill bit. A pair of handles 104 are coupled with and extend upward from the wrench portion 102. The handles 104 are in a fixed position such that the handles 104 serve as the highest point of the bit breaker 100. Due to the relatively high height of the handles 104, the handles are often ground down and/or otherwise removed in the field to prevent the handles 104 from getting in the way of workers who are trying to access a drill bit being held by the wrench portion 102. However, once the handles are removed, it becomes significantly more difficult to carry and/or otherwise manipulate the bit breaker 100. Bit breaker 100 also includes a gate 108 that is moveable between a closed position that closes the end of the slot 106 to help retain a drill bit shank within the wrench portion 102 and an open position in which the slot 106 is open that allows a bit to be inserted and/or removed from the wrench portion 102. Here, gate 108 is sits atop of the wrench portion 102. As seen here, both the gate 108 and the handles 104 protrude upward beyond a top surface of the wrench portion 102 and obstruct both access and visibility to any drill bit that is secured within the wrench portion 102. Additionally, when placed into the rig master bushing of a drilling rig, conventional bit breakers such as bit breaker 100 have a low profile that keeps all or most of the bit breaker 100 positioned within the rig master bushing such that access to the bit breaker 100 is further limited, while also keeping the connection point between the wrench portion 102 and the drill bit shank obscured. Additionally, due to the wrench portion 102 of the bit breaker 100 being at a same height as the portion of the bit breaker that is inserted within the rig master bushing, the wrench portion 102 and the portion of the shank of the drill bit being secured to the drill string sit within the rig master bushing, further limiting access to the connection point.

Bit breakers according to the present invention provide greater access and visibility by incorporating a wrench portion that projects upward from a base, thereby increasing the total height of the bit breaker (and the connection point with the shank of the drill bit) such that a portion (or greater) portion of the bit breaker (as well as the shank) projects upward and outward from the drilling rig, more specifically from the rig master bushing and/or rotary table. Additionally, articulable handles are provided that, when not in use, collapse downward such that the handles do not project upward beyond the top of the wrench portion. Similarly, bit breakers in accordance with the present invention include a movable gate that is designed to sit below a top of the wrench portion. In such a manner, the wrench portion remains the highest component of the bit breaker and maximizes visibility and access to the drill bit.

Figure 2:
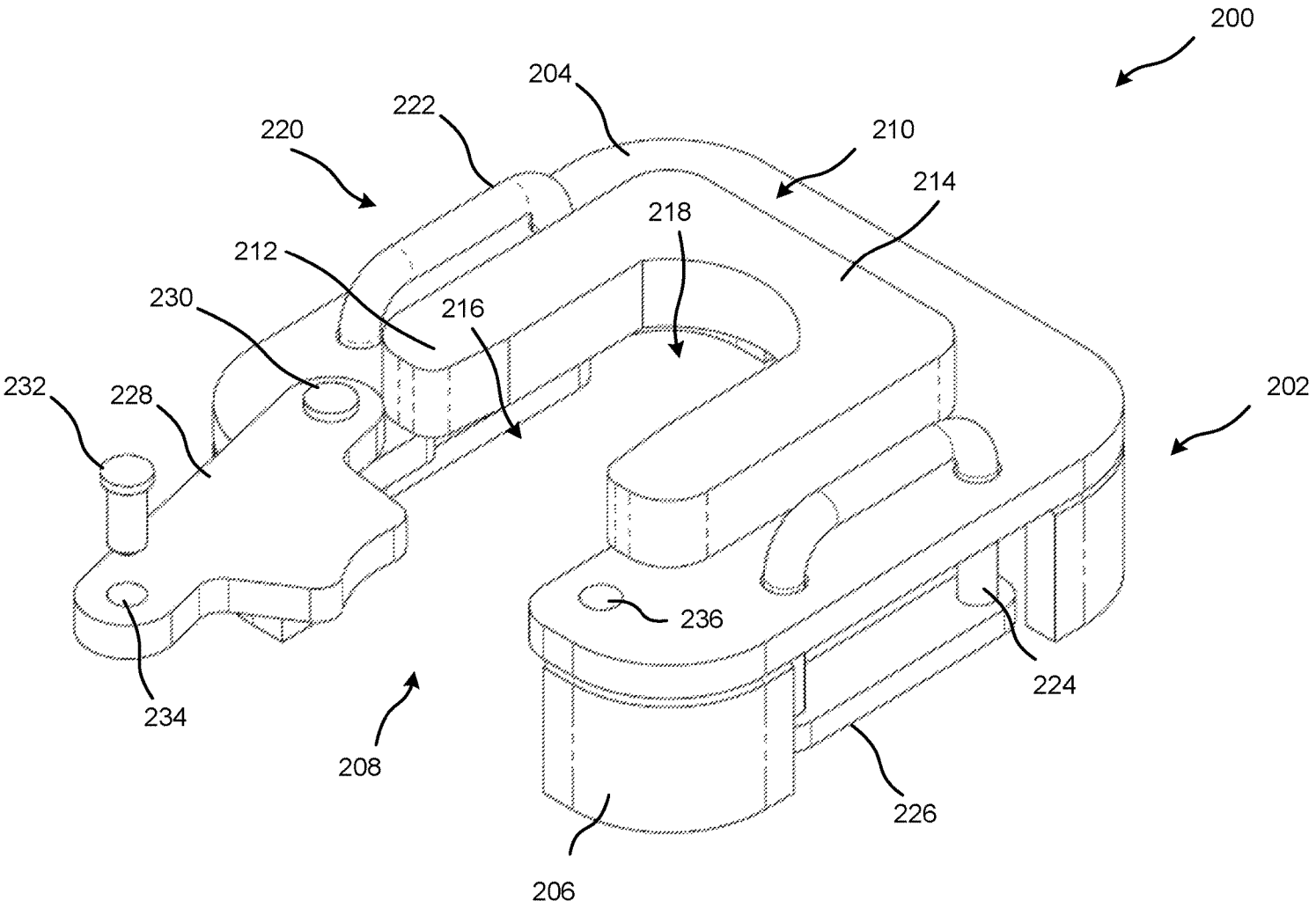
FIG. 2 depicts an isometric view of a bit breaker according to embodiments of the invention.

One embodiment of a bit breaker 200 in accordance with the present invention is illustrated in FIG. 2. Bit breaker 200 includes a base 202 that is configured to be inserted into a master bushing of a rotary table of a drilling rig. The base 202 may have a thickness that is sufficient such that a top surface of the base 202 is at a height of a top of the master bushing and/or at a height near a top of the rig master bushing such that the bit breaker 200 is inserted within the rig master bushing, all or a substantial portion of the components positioned above the base 202 project upward and out of the rig master bushing, thereby increasing an amount of access to the upper components of the bit breaker 200 and/or a drill bit secured therein. The base 202 may have an outer periphery that is sized and shaped to match an opening of the rig master bushing. As illustrated, base 202 includes a base plate 204 that has a generally rectangular outer periphery having rounded corners, however it will be appreciated that other shapes of plates may be utilized to match the opening of the rig master bushing. In some embodiments, the base 202 may include a number of corner reinforcement members 206 that extend downward from a bottom of the base plate 204 at each corner of the base plate 204. The corner reinforcement members 206 allow the thickness of the base 202 to be increased in areas that are exposed to the highest amount of torque during the drill bit attachment/detachment process while still minimizing the amount of material needed for the base 202 as a whole. This helps cut down on the weight as well as material cost of the bit breaker 200. It will be appreciated that in some embodiments, the base plate 204 and the corner reinforcement members 206 may be formed separately and subsequently attached to one another. For example, the base plate 204 and the reinforcement members may be welded, fastened, and/or otherwise secured to one another. In other embodiments, the base plate 204 and the corner reinforcement members 206 may be formed integrally with one another.

The base 202 may define a central opening 208 that allows a drill bit and/or drill string to extend through the base 202. In some embodiments, the central opening 208 may extend from a center of the base 202 through one of the edges of the base, thereby forming an elongated channel that gives a base 202 a generally u-shaped profile having two side structures and an end structure. For example, the side structures and the end structure may be formed by at least a portion of the base plate 204. By extending through to the edge, lateral access is provided to the central opening 208 which allows the bit breaker 200 to be pulled around the drill bit and/or drill string such that the drill bit and/or drill string is positioned within the center of the bit breaker 200.

Bit breaker 200 may also include a wrench portion 210 that is coupled atop the base 202. For example, as illustrated, wrench portion 210 is coupled with a top surface of the base plate 204. In the illustrated embodiment, wrench portion 210 extends above the base 202 and the remaining components of the bit breaker 200 such that in the default state of the bit breaker 200 the wrench portion 210 serves as the highest component of the bit breaker 200 to maximize access to and visibility of the bit breaker 200 and any drill bit held within. For example, by placing the wrench portion 210 entirely atop the base 202, the shank of the drill bit may be substantially and/or entirely elevated out of the rig master bushing, thereby increasing the amount of access for tooling Wrench portion 210 may be generally u-shaped and may include two opposing lateral sides 212, an end wall 214, and one open end 216. The lateral sides 212 and an end wall 214 may define an open interior 218 that is configured to receive a shank of a drill bit. The open interior 218 may be in alignment with at least a portion of the central opening 208 of the base 202 such that the drill bit and/or drill string may extend through the entire bit breaker 200. The interior surface of each of the two opposing lateral sides 212 is generally flat and an interior surface of the end wall 214 is generally concave to define an elongate slot with a curved end that forms the open interior 218 of the wrench portion 210. The flat sides of the elongate slot may be configured to engage slats of the shank of the drill bit so as to fix the orientation of the drill bit relative to the bit breaker 200 such that if the bit breaker 200 is rotated, the drill bit is rotated to a same degree or if the bit breaker 200 is maintained at one angular position, the drill bit also remains at the same angular position.

Oftentimes, the wrench portion 210 may be formed from a stronger material than the base 202. This allows the wrench portion 210 to be smaller and/or thinner than the base 202, while still being able to withstand the same amount of torque. As just one example, the base 202 may be formed from 60ksi hot rolled and tempered steel plate stock, while the wrench portion 210 may be formed from 100ksi QT100 steel. It will be appreciated that these are merely example materials, and that other steels and/or other metal alloys may be used in accordance with the strength requirements of a particular drilling application. Moreover, in some embodiments, the wrench portion 210 and the base 202 may be formed from a single type of material. In some embodiments, the wrench portion 210 may be formed separately from the base 202 and later secured to the base 202. As just one example the wrench portion 210 may be welded, fastened, and/or otherwise secured to the base 202 (such as to a top surface of the base plate 204) to couple the components together. In other embodiments, the wrench portion 210 and the base 202 may be formed integrally with one another.

The bit breaker 200 may also include one or more handles 220 that are coupled with the base 202. As illustrated, two handles 220 are positioned on the base 202 outward from the lateral sides 212, although it will be appreciated that any number and/or arrangement of handles 220 may be utilized on a particular bit breaker 200. To ensure that the handles 220 are usable while remaining at a height lower than the wrench portion 210, the handles 220 may be configured to extend upward from the base 202 when in use and to fall back into and/or fold up against the base 202 when not in use. As just one example, each handle 220 may include a handle portion 222 that is configured to be grasped by a human to lift and/or otherwise manipulate the bit breaker 200. The handles 220 may also include one or more slidable portions 224 that extend through at least a portion of the base 202 and are coupled with the handle portion 222. As illustrated, handles 220 each include two slidable portions 224 that extend through channels formed within the side structures of base plate 204. The slidable portions 224 are oriented in a generally vertical manner such that the slidable portions 224 may slide up and down within the channels within the side structures of base plate 204. To retain the slidable portions 224 within the channels, a stiffening retention member 226 is coupled with bottoms of each of the two slidable portions 224 at a position below the channels of the base 202. In addition to retaining the slidable portions 224 within the channels, the stiffening retention member 226 helps provide additional strength to the handles 220 that helps prevent the slidable portions 224 from being bent and/or otherwise damaged during use and also limits a height of the handles 220 relative to the base 202 when in a fully extended toting position. The handle portion 222, slidable portions 224, and stiffening retention member 226 together form a closed loop structure that is slidable relative to the base 202 and stays in engagement with the base 202 at all times.

When a user wishes to move and/or otherwise manipulate the bit breaker 200, the user may grasp one or more of the handles 220 and apply an upward force to the handle(s) 220. This draws the handle(s) 220 upward until the stiffening retention member 226 contacts an underside of the side structure of the base 202. Once contacting the underside of the side structure of the base 202, the stiffening retention members 226 pull the bit breaker 200 upward into a toting position in which the handle extends upward with the top handle being positioned above the top surface of the wrench portion 210. In the toting position, the handle 220 allows the bit breaker 200 to be supported by the handles 220. Once the bit breaker 200 is positioned correctly, the user may let go of the handle(s) 220 and the weight of the stiffening retention members 226 causes the slidable portions 224 to slide downward within the channels, thereby drawing the handles 220 downward into a storage position in which a top of the handles 220 remains below a top surface of the wrench portion 210.

While disclosed with slidable handles 220 that are inserted through a portion of the base 202, it will be appreciated that other collapsible handle designs may be utilized in accordance with the present invention. For example, handles on telescoping supports, handles that may be folded against and/or collapsed against a surface of the base 202 and/or other movable handles may be used. As just example, a bracket may be provided on a top of the base 202 that enables a handle to be pivotally mounted to the base 202. When in use, a user may grasp the handle and pivot the handle away from the surface of the base 202 such that the handle projects in a generally orthogonal direction relative to the surface of the base 202. When not in use, the handle may pivot downward such that the handle is substantially parallel with the surface of the base 202.

The bit breaker 200 may also include a gate 228 that is positioned along one side of the bit breaker 200. As illustrated, the gate 228 is positioned atop a portion of the base plate 204 and serves to connect opposing ends of the two side structures. Gate 228 may be designed such that a top surface of the gate 228 is maintained at a lower position than the top surface of the wrench portion 210. When closed, gate 228 may be configured to close the open interior 218 and/or central opening 208 to secure the drill bit shank within the open interior 218 and/or central opening 208. In some embodiments, the gate 228 may be pivotally coupled with the base 202. For example, a pin 230 may be inserted through one end of the gate 228 and through at least a portion of the base 202 to pivotally couple the end of the gate 228 with the base 202. The pin may act as a hinge that allows the gate 228 to be rotated about the pin 230 to open and close the gate 228. The gate 228 may be movable between a retaining position in which the gate 228 encloses the open interior 218 of the wrench portion 210 and/or the central opening 208 of the base 202, and an access position that opens up an end of the open interior 218 of the wrench portion 210 and/or the central opening 208 of the base 202 provides lateral access to the open interior 218 of the wrench portion 210 and/or the central opening 208 of the base 202.

When in the retaining position, oftentimes the gate 228 may not be in contact with the shank of the drill bit, but rather provides a stop that limits movement of the drill bit relative to the bit breaker 200 in the event that the shank of the drill bit slides within the open interior 218. The gate 228 may include a locking member that may be engaged to secure the gate 228 in the retaining position. For example, as illustrated, the gate 228 includes a retention pin 232 that is configured to be inserted through a channel 234 formed through a second end of the gate 228 and a channel 236 formed at least partially through the base 202 to secure the gate 228 in the retaining position. When the gate 228 is to be opened to the access position, the retention pin 323 may be removed from one or both of the channels 234, 236 such that the gate 228 may be pivoted relative to the base 202. While not shown, the retention pin 232 may include a retention member, such as a cord or chain, that couples the retention pin 232 to the base 202 such that the retention pin 232 is easily locatable.

It will be appreciated that other locking mechanisms, such as latches, magnet elements, clasps, and/or other mechanical securement mechanisms may be used to secure the gate 228 in a retaining position. Additionally, in some embodiments, the gate 228 may be fully removable from the bit breaker 200. In other embodiments, rather than pivoting in a lateral direction, the gate 228 may pivot upward relative to the base 202.

Figure 3:
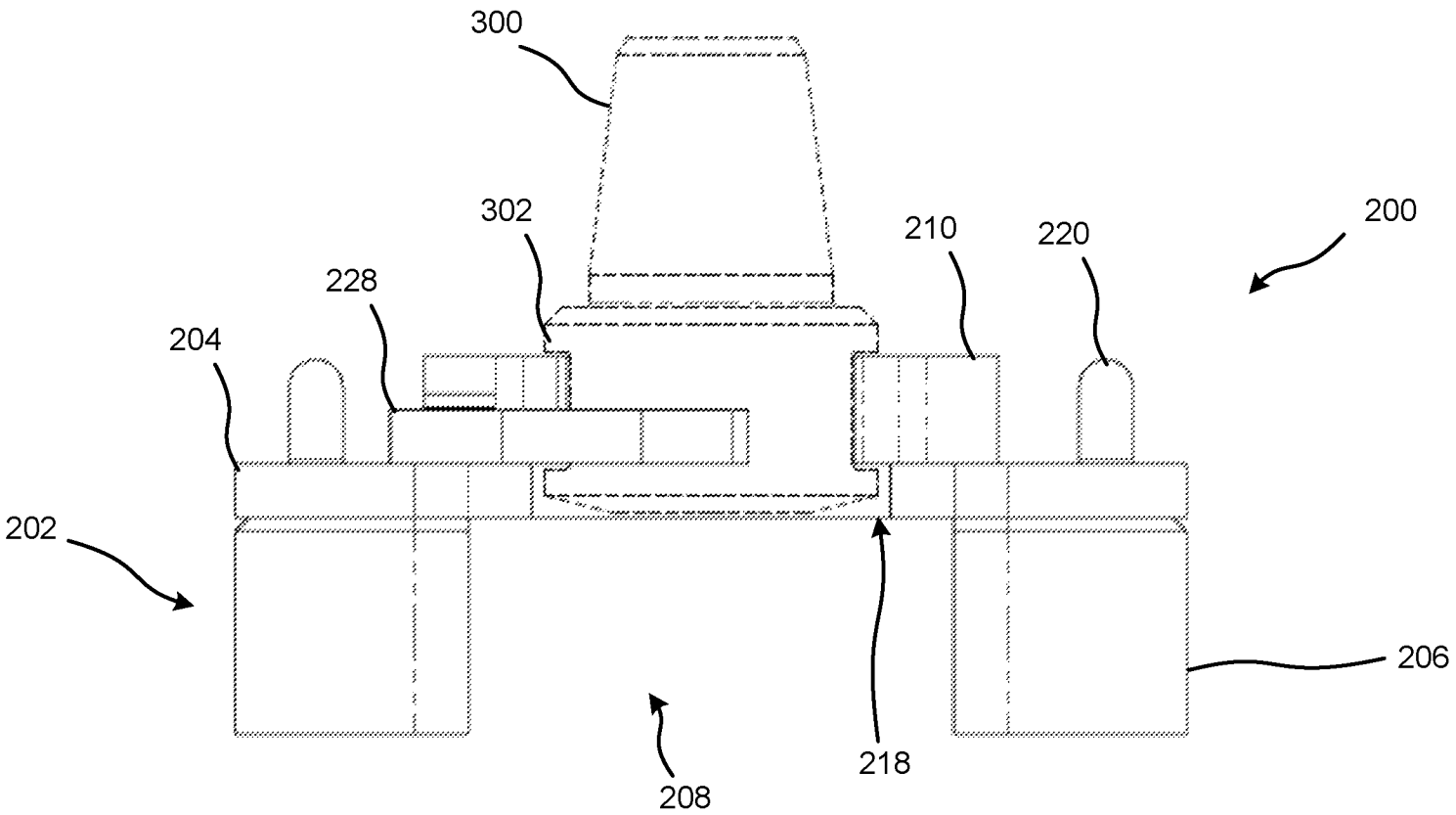
FIG. 3 depicts a front view of the bit breaker of FIG. 2 in engagement with a drill bit shank according to embodiments.

As illustrated in FIG. 3, bit breaker 200 maintains the wrench portion 210 at a highest position, with both the gate 228 and handles 220 projecting upward from the base 202 at a height that is the same or lower than the top surface of the wrench portion 210 when the handles 220 are in a default, storage position. This configuration ensures that visibility and access to the wrench portion 210 and a shank 302 of a drill bit 300 are not obstructed by any of the components of the bit breaker 200, specifically the handles 220 and the gate 228. Additionally, the base 202 may be designed such that a thickness of the base 202 matches or substantially matches the depth of the opening of the rig master bushing such that all or a substantial portion of the wrench portion 210 extends above the rig master bushing. By placing the wrench portion 210 above the rig master bushing, the shank 302 is held at a higher position relative to the rig master bushing, which provides greater visibility and tooling access to the shank 302.

In use, the gate 228 may be manipulated to the access position and the shank 302 of the drill bit 300 may be inserted within the open interior 218 of the wrench portion 210 and/or the central opening 208 of the base 202. The gate 228 may be closed into the retaining position and the bit breaker 200 may be maneuvered into position within the rig master bushing using handles 220, which may be extended to the toting position by applying upward fore to the handle. The base 202 may be inserted into the rig master bushing, which may grab and apply force to the outer periphery of the base 202, which holds the shank 302 in a fixed orientation relative to the bit breaker 200. The bit breaker 200 holds the drill bit 300 stationary while the drill string is rotated for tightening or loosening the bit 300 thereto.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A bit breaker for coupling a drill bit to a drilling string, comprising:

a generally rectangular base comprising a first side structure and a second side structure, the generally rectangular base defining a central opening extending from a center of the generally rectangular base through a first end of the generally rectangular base;

a wrench portion extending upward from the base, the wrench portion having two opposing lateral sides and an end wall that define an open interior that is configured to receive a shank of a drill bit, wherein the open interior and the central opening are in alignment with one another;

a first handle having a first slidable portion that extends through at least a portion of the first side structure and a stiffening retaining member coupled with a bottom portion of the first handle;

a second handle having a second slidable portion that extends through at least a portion of the second side structure and a stiffening retaining member coupled with a bottom portion of the second handle, wherein each of the first handle and the second handle is movable between a storage position in which a top of the respective handle is positioned below a top surface of the wrench portion and a toting position in which the respective handle extends upward with the top of the respective handle being positioned above the top surface of the wrench portion; and a gate that is movable between a retaining position in which the gate encloses the open interior of the wrench portion and an access position that provides lateral access to the open interior.

2. The bit breaker for coupling a drill bit to a drilling string of claim 1, wherein:

the gate is pivotally coupled with the base; and the gate comprises a locking mechanism that maintains the gate in the retaining position when engaged.

3. The bit breaker for coupling a drill bit to a drilling string of claim 2, wherein:

the locking mechanism comprises a pin that is insertable through a first opening defined by a body of the gate and a second opening defined by the base.

4. The bit breaker for coupling a drill bit to a drilling string of claim 1, wherein:

an interior surface of each of the two opposing lateral sides is generally flat and an interior surface of the end wall is generally concave to define an elongate slot with a curved end that forms the open interior of the wrench portion.

5. The bit breaker for coupling a drill bit to a drilling string of claim 1, wherein:

the base further comprises a corner reinforcement member extending downward from each corner of the generally rectangular base.

6. The bit breaker for coupling a drill bit to a drilling string of claim 1, wherein:

a top surface of the gate is at a height that is lower than the top surface of the wrench portion.

7. The bit breaker for coupling a drill bit to a drilling string of claim 1, wherein:

the first handle is positioned outside of a first of the two opposing lateral sides and the second handle is positioned outside of a second of the two opposing lateral sides.

8. The bit breaker for coupling a drill bit to a drilling string of claim 1, wherein:

the wrench portion is formed from a stronger material than the base.

9. The bit breaker for coupling a drill bit to a drilling string of claim 1, wherein:

each of the first handle and the second handle form a closed loop structure that is slidable relative to the base.

10. The bit breaker for coupling a drill bit to a drilling string of claim 1, wherein:

each stiffening retention member is configured to contact an underside of the respective side structure to limit a distance the respective handle extends upward from the base.

11. A bit breaker for coupling a drill bit to a drilling string, comprising:

a base defining a central opening;

a wrench portion extending upward from the base, the wrench portion having two opposing lateral sides and an end wall that define an open interior that is configured to receive a shank of a drill bit, wherein the open interior and the central opening are in alignment with one another;

at least one handle coupled with the base, wherein the at least one handle is movable between a storage position in which a top of the at least one handle is positioned below a top surface of the wrench portion and a toting position in which the at least one handle extends upward with the top of the at least one handle is positioned above the top surface of the wrench portion; and a gate that is movable between a retaining position in which the gate encloses the open interior of the wrench portion and an access position that provides lateral access to the open interior.

12. The bit breaker for coupling a drill bit to a drilling string of claim 11, wherein:

each of the at least one handle comprises a handle portion, two slidable portions that extend through at least a portion of the base and are coupled with the at least one handle, and a stiffening retention member coupled with the two slidable portions at a position below the at least the portion of the base.

13. The bit breaker for coupling a drill bit to a drilling string of claim 12, wherein:

the stiffening retention member is configured to contact an underside of the at least a portion of the base to limit a distance the at least one handle extends upward from the base.

14. The bit breaker for coupling a drill bit to a drilling string of claim 11, wherein:

the gate is pivotally coupled with the base; and the gate comprises a locking mechanism that maintains the gate in the retaining position when engaged.

15. The bit breaker for coupling a drill bit to a drilling string of claim 14, wherein:

the locking mechanism comprises a pin that is insertable through a first opening defined by a body of the gate and a second opening defined by the base.

16. The bit breaker for coupling a drill bit to a drilling string of claim 11, wherein:

an interior surface of each of the two opposing lateral sides is generally flat and an interior surface of the end wall is generally concave to define an elongate slot with a curved end that forms the open interior of the wrench portion.

17. The bit breaker for coupling a drill bit to a drilling string of claim 11, wherein:

the at least one handle is slidable from the storage position and the toting position by applying upward force to the at least one handle; and the at least one handle is configured to return from the toting position to the storage position when no upward force is applied to the at least one handle.

18. The bit breaker for coupling a drill bit to a drilling string of claim 11, wherein:

the base comprises a generally rectangular plate from which the wrench portion extends, the generally rectangular plate defining a slot extending from a first side to a center of the generally rectangular plate.

19. The bit breaker for coupling a drill bit to a drilling string of claim 18, wherein:

the base further comprises a corner reinforcement member extending downward from each corner of the generally rectangular plate.

20. The bit breaker for coupling a drill bit to a drilling string of claim 11, wherein:

a top surface of the gate is at a height that is lower than the top surface of the wrench portion.

* * * * *